US006822403B2

(12) United States Patent
Horiuchi et al.

(10) Patent No.: US 6,822,403 B2
(45) Date of Patent: Nov. 23, 2004

(54) LIGHT EMITTING ELEMENT DRIVE DEVICE AND ELECTRONIC DEVICE HAVING LIGHT EMITTING ELEMENT

(75) Inventors: Sachito Horiuchi, Kyoto (JP); Ken Hoshino, Kyoto (JP); Isao Yamamoto, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/482,430

(22) PCT Filed: May 1, 2003

(86) PCT No.: PCT/JP03/05587

§ 371 (c)(1),
(2), (4) Date: Dec. 29, 2003

(87) PCT Pub. No.: WO03/096436

PCT Pub. Date: Nov. 20, 2003

(65) Prior Publication Data

US 2004/0208011 A1 Oct. 21, 2004

(30) Foreign Application Priority Data

May 7, 2002 (JP) ..... 2002-131808

(51) Int. Cl.[7] ..... H05B 37/00
(52) U.S. Cl. ..... 315/307; 315/308
(58) Field of Search ..... 315/307, 308, 315/224

(56) References Cited

U.S. PATENT DOCUMENTS 4,160,934 A * 7/1979 Kirsch ..... 315/307
6,362,578 B1 * 3/2002 Swanson et al. ..... 315/307

FOREIGN PATENT DOCUMENTS

| | | |
|---|---|---|
| JP | 63-226079 | 9/1988 |
| JP | 4-27172 | 1/1992 |
| JP | 5-152662 | 6/1993 |
| JP | 7-235693 | 9/1995 |
| JP | 2001-45747 | 2/2001 |
| JP | 2001-215913 | 8/2001 |
| JP | 2002-111786 | 4/2002 |

* cited by examiner

*Primary Examiner*—David Vu
(74) *Attorney, Agent, or Firm*—Hogan & Hartson LLP

(57) ABSTRACT

An electronic apparatus is equipped with light emitting elements (21–26) such as LEDs. The light emitting elements are driven by a power supply circuit of the drive device (10) at a high step-up voltage (Vh). The drive device (10) has a multiplicity of constant-current drivers (12–14), a selection circuit (18), and a control circuit (11). The drivers are turned ON or OFF in accordance with respective instruction signals (S1–S3) supplied thereto to provide associated series with currents to activate the series for emission of light when associated drivers are turned ON. The selection circuit (18) selects the lowest one of the voltages impressed on the drivers and outputs the selected lowest voltage as a detection voltage. The control circuit (11) automatically controls the voltage Vh so as to equilibrate the detection voltage with a low reference voltage at which the drivers can perform required constant-current operations. Thus, the drive device can fully activate the light emitting elements for emission of light while suppressing energy loss in the drivers.

9 Claims, 5 Drawing Sheets

LIGHT EMITTING ELEMENT DRIVE DEVICE AND ELECTRONIC DEVICE HAVING LIGHT EMITTING ELEMENT

TECHNICAL FIELD

This invention relates to a drive device for driving light emitting elements such as light emitting diodes (LEDs) operated at high voltages, and to an electronic apparatus equipped with such light emitting elements.

BACKGROUND ART

Light emitting elements such as LEDs are used not only as display elements themselves but also as backlight sources of a liquid crystal display (LCD). The number of light emitting elements used depends on the form of the display and the amount of light required for the display.

FIG. 4 illustrates a conventional circuit for driving LEDs for use with an electronic apparatus such as a cellular phone. The circuit includes a drive device 30 for driving a display device 40.

The display device 40 has groups of two serially connected LEDs 41 and 42 (the groups referred to as a first light emitting element series), two serially connected LEDs 43 and 44 (the groups referred to as a second light emitting element series), and two serially connected LEDs 45, and 46 (the groups referred to as a third light emitting element series). The numbers of light emitting element series and the LEDs in the respective series are given merely for illustration. The numbers and configurations of the series and LEDs can be determined arbitrarily as needed.

On the other hand, the drive device 30 includes a step-up type switching power supply circuit 31 for stepping up a power supply voltage Vdd (typically 4V) of a lithium battery for example to a higher step-up output voltage Vh. The step-up voltage Vh is fed back as a detection voltage Vdet to a control circuit 32. The control circuit 32 controls the power supply circuit 31 such that the voltage Vh remains constant by comparing the detection voltage Vdet with a reference voltage (not shown).

The step-up voltage Vh is set to 9V say, based on the fact that a white and a blue LED requires about 4V for emission of light. This step-up voltage Vh is applied to the LEDs 41–46 through the pin P31 of the drive device 30 and the pin P41 of the display device 40.

Since LEDs are constant-current elements, drivers 33–35 are usually implemented as constant-current drivers activated by respective constant-currents. Each of the constant-current drivers 33–35 provides a constant current Il when turned ON, irrespective of the number of LEDs in a series, and shuts down the current when turned OFF. The drivers are respectively turned ON or OFF in accordance with respective instruction signals S1–S3 to control associated LEDs 41–46 of the display device 40.

Incidentally, although a constant current Il is provided to the LEDs of a series for emission of light, voltage drop across one LED differs from one LED to another due to the fact that LEDs have production tolerance. As a result, the voltage drop varies in the range of about 3.4V–4.0V for a white LED when the constant current Il is 20 mA.

On the other hand, the constant-current drivers 33–35 are usually implemented in the form of transistor circuits, which are adapted to perform constant-current operations in the active region of the transistors. Therefore, as shown in FIG. 5, in order to place a transistor in its active region, a voltage greater than Vce0 is required across the collector and the emitter. (The voltage will be referred to as transistor voltage.) In FIG. 5, Ic represents collector current of a transistor. If the voltage applied to the transistor is less than the predetermined transistor voltage Vce0, for example Vce2 as shown in FIG. 5, the transistor falls into a saturation region, whereby the transistor cannot maintain its constant current operation any longer. Then, the required constant current Il is not provided to the LED, so that the LED stops emission of light and fails to function as a light-emitting element of the display.

In order to circumvent such condition, the step-up voltage Vh is set to a voltage, for example 9V, that is sufficient for activation of two LEDs each requiring at most 4V, plus the transistor voltage Vce0 and an extra margin.

In actuality, however, the constant-current drivers 33–35 are each impressed with the voltage that amounts to the difference between the step-up voltage Vh and the voltage drop across the associated LEDs. This voltage difference is shown in FIG. 5 as transistor voltage Vce1. The voltage difference turns out to be 2.2V for example when the voltage drop per LED is 3.4V. As the number of the LEDs in the series increases, this voltage difference becomes still larger.

The foregoing discussion on the variation of the light emitting characteristic also holds in a case where a multiplicity of light emitting element series are driven by a step-up voltage. It is necessary then to set the step-up voltage Vh at a higher voltage that takes account of the variations in the characteristics of the multiple series. As a consequence, the current drivers are impressed with higher voltages than necessary.

It is noted that the difference a between the actual transistor voltage Vce1 and the actually required transistor voltage Vce0 results in an energy loss in each of the constant-current drivers 33–35. For this reason, it is necessary to make the constant-current drivers 33–35 large in size, which will lower the power efficiencies of the drive device.

It is, therefore, an object of the invention to provide a drive device for driving light emitting elements, formed of low-voltage ICs and operable with a reduced power loss. This can be attained by forming the drive device such that it always provides a lower voltage than a power supply voltage to the pins to which the light emitting elements are connected, irrespective of the number of the light emitting elements connected. It is another object of the invention to provide an electronic apparatus equipped with such light emitting elements.

It is a further object of the invention to provide a drive device comprising a multiplicity of constant-current drivers for driving multiple groups of serially connected light emitting elements (the groups referred to as light emitting element series), the drive device adapted to automatically control the voltages impressed on the drivers to a predetermined level while performing its normal constant-current operation with a reduce power loss, irrespective of the variations in light emitting characteristic of the light emitting elements. It is a still further object of the invention to provide an electronic apparatus equipped with such light emitting elements.

DISCLOSURE OF INVENTION

In accordance with one aspect of the invention, there is provided a drive device for driving a multiplicity of light emitting element series each including at least one light emitting element, the drive device comprising:

a multiplicity of drivers having first ends connected to a multiplicity of terminals to which the light emitting element series are respectively connected, each of the drivers turned ON or OFF in accordance with an instruction signal supplied thereto such that, when turned ON, said driver provides a current to associated one of the light emitting element series for emission of light;

a selection circuit receiving the voltages that are respectively impressed on the drivers, the selection circuit adapted to select the lowest voltage from the voltages and output the lowest voltage as a detection voltage; and a control circuit for controlling, the drive voltage applied to the light emitting element series by a power supply circuit by comparing the detection voltage with a reference voltage to generate a control signal to the power supply circuit so as to equilibrate the detection voltage with the reference voltage. The light emitting elements may be light emitting diodes.

In accordance with another aspect of the invention, there is provided an electronic apparatus equipped with light emitting elements, the electronic apparatus comprising:

a display device having:

a power supply circuit for converting a given power supply voltage to another output voltage in response to a control signal supplied thereto; and a multiplicity of light emitting element series each including at least one light emitting element and having a first end connected to the output voltage and a second end connected to associated one of different terminals, and a drive device having:

a multiplicity of drivers having first ends connected to the different terminals, each of the drivers turned ON or OFF in accordance with an instruction signal supplied thereto such that, when turned ON, the driver provides a current to activate associated one of the light emitting element series for emission of light;

a selection circuit receiving voltages that are respectively impressed on the drivers, the selection circuit adapted to select the lowest voltage from the voltages and output the lowest voltage as a detection voltage; and a control circuit for outputting the control signal to the power supply circuit so as to equilibrate the detection voltage with the reference voltage by comparing the detection voltage with a reference voltage. The light emitting elements may be light emitting diodes.

In this arrangement, light emitting element series are respectively turned ON or OFF in accordance with the ON-OFF status of the associated drivers. Moreover, the output voltage of the power supply circuit is automatically controlled in such a way that the detection voltage is equilibrated with the low reference voltage for the constant-current drivers to perform their normal constant-current operations. Accordingly, the light emitting elements can be fully energized for emission of light on one hand, and on the other hand the energy loss by the drivers can be minimized, even if the light emitting elements such as LEDs have variations in light emitting characteristic.

The drive device is further provided with a multiplicity of bypass means, each connected in parallel with associated one of the drivers, for providing the light emitting element series with currents that are not sufficient to activate the light emitting element series for emission of light when associated drivers are turned OFF. Hence, the terminals to which the light emitting elements are connected are only impressed with low voltages even when the associated drivers are turned OFF. Therefore, ICs designed to operate only at low voltages (referred to as low-voltage ICs) can be utilized to form the drive device for driving the light emitting element series, irrespective of the voltage required for the light emitting element series to emit light.

The drivers may be constant-current drivers for providing a constant current when they are turned ON. The bypass means may be constant-current sources. When a driver is turned OFF, the current flowing through the associated bypass means can set up a predetermined weak current through it, and hence through the associated light emitting element series. Under this condition, the light emitting element series is maintained in a stable non-luminescent condition.

BEST MODE FOR CARRYING OUT THE INVENTION

Referring to the accompanying drawings, the invention will now be described in detail by way of example, with a particular reference to an electronic apparatus equipped with LEDs serving as light emitting elements.

Figure 1:
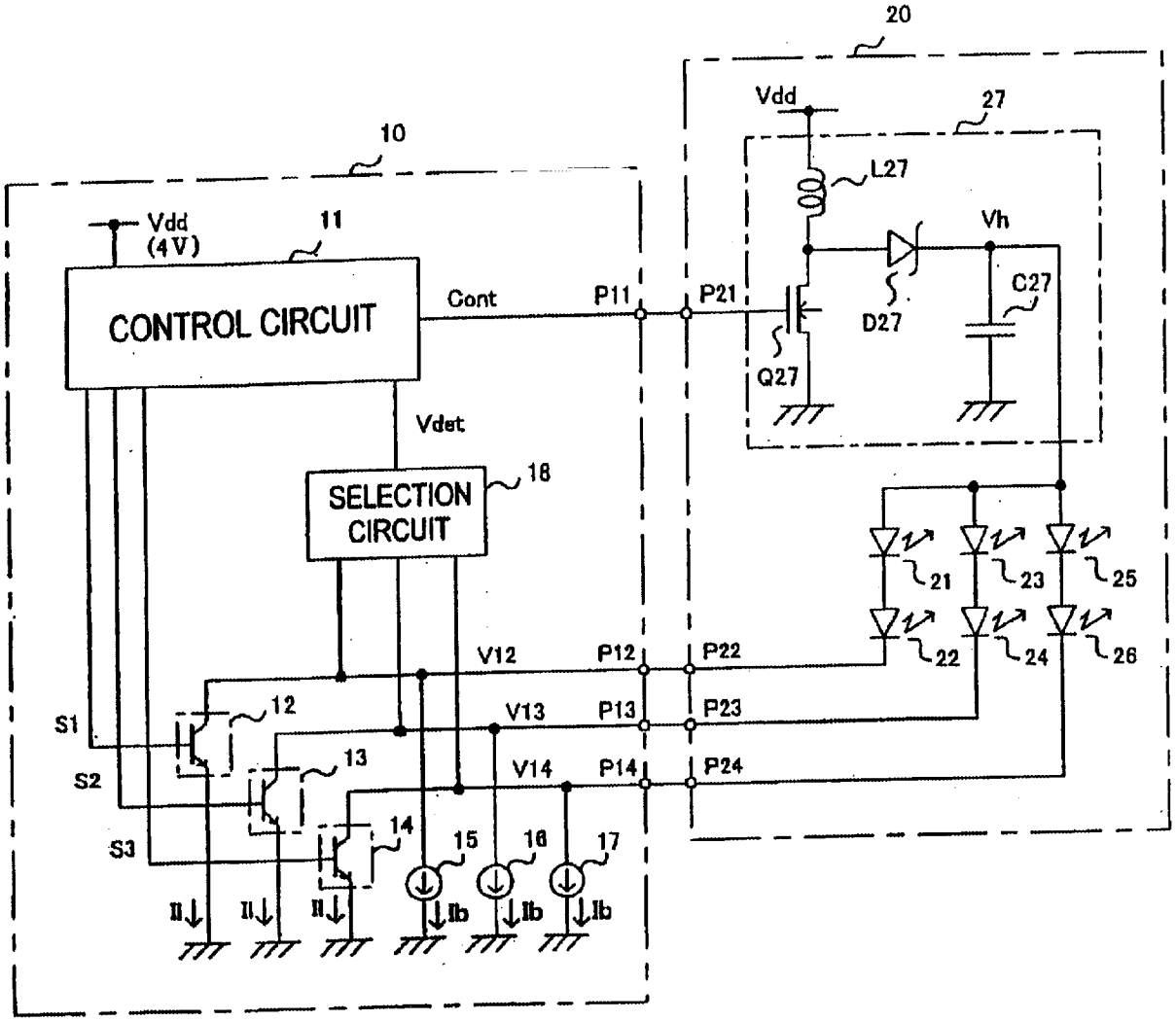
FIG. 1 is a general circuit diagram of an electronic apparatus equipped with light emitting elements in accordance with the invention.
Figure 2:
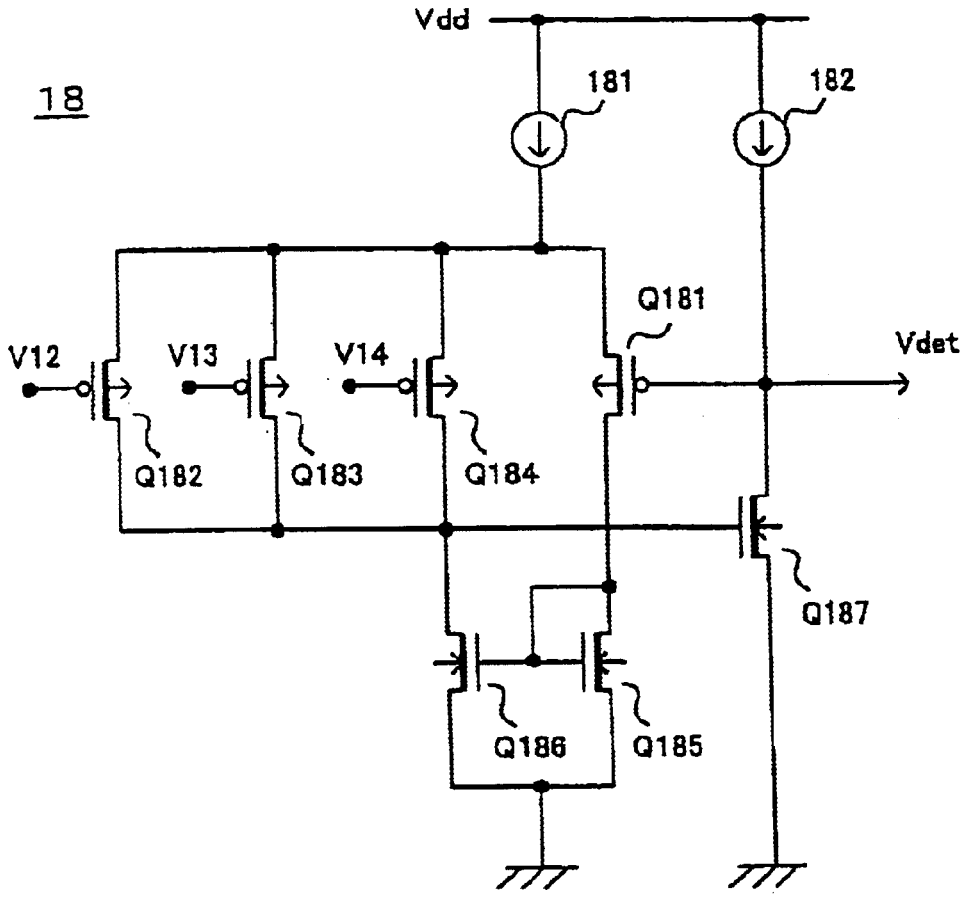
FIG. 2 is a circuit diagram of a selection circuit of FIG. 1.
Figure 3:
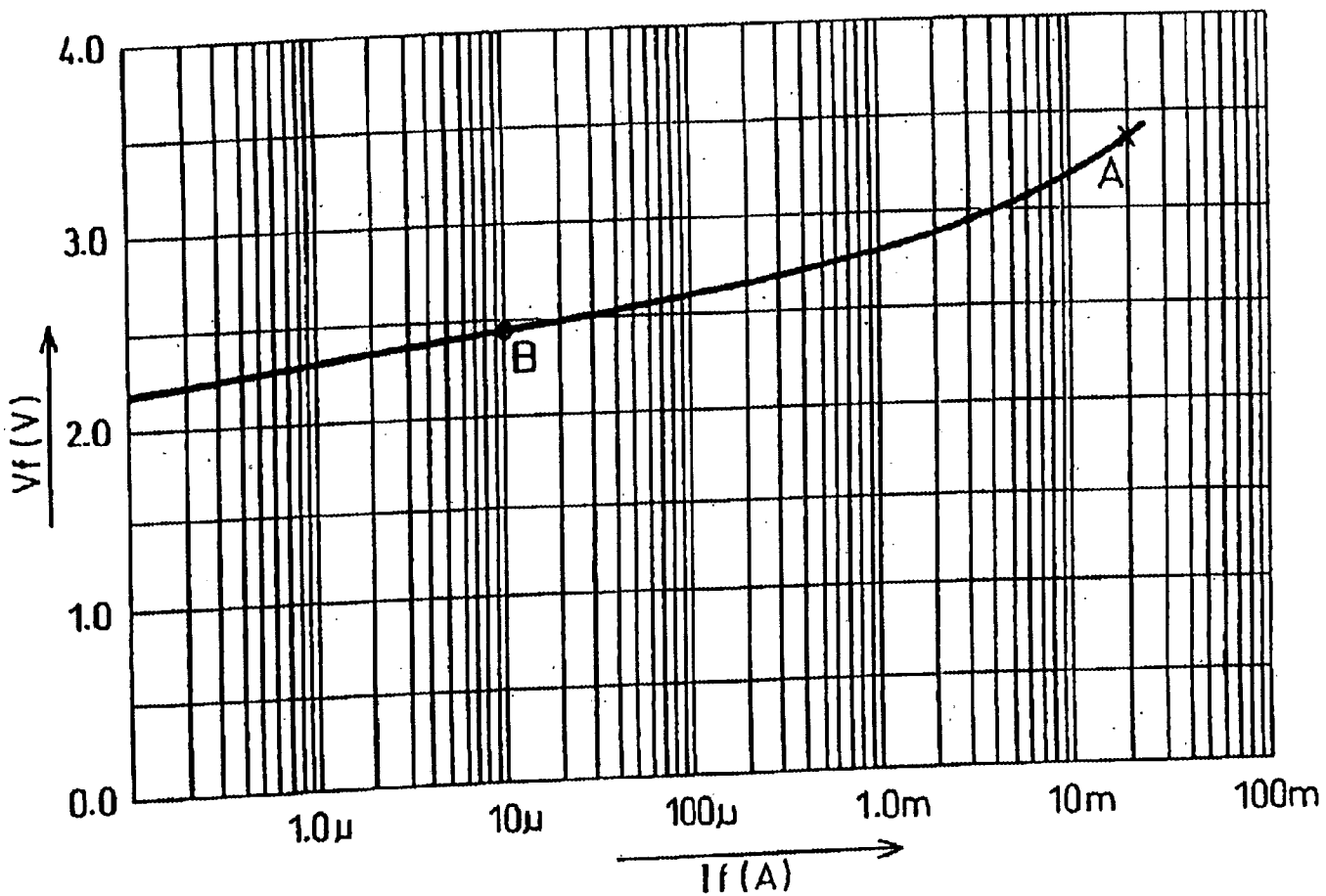
FIG. 3 shows the current-voltage characteristic of an LED for use as a light emitting element.
Figure 4:
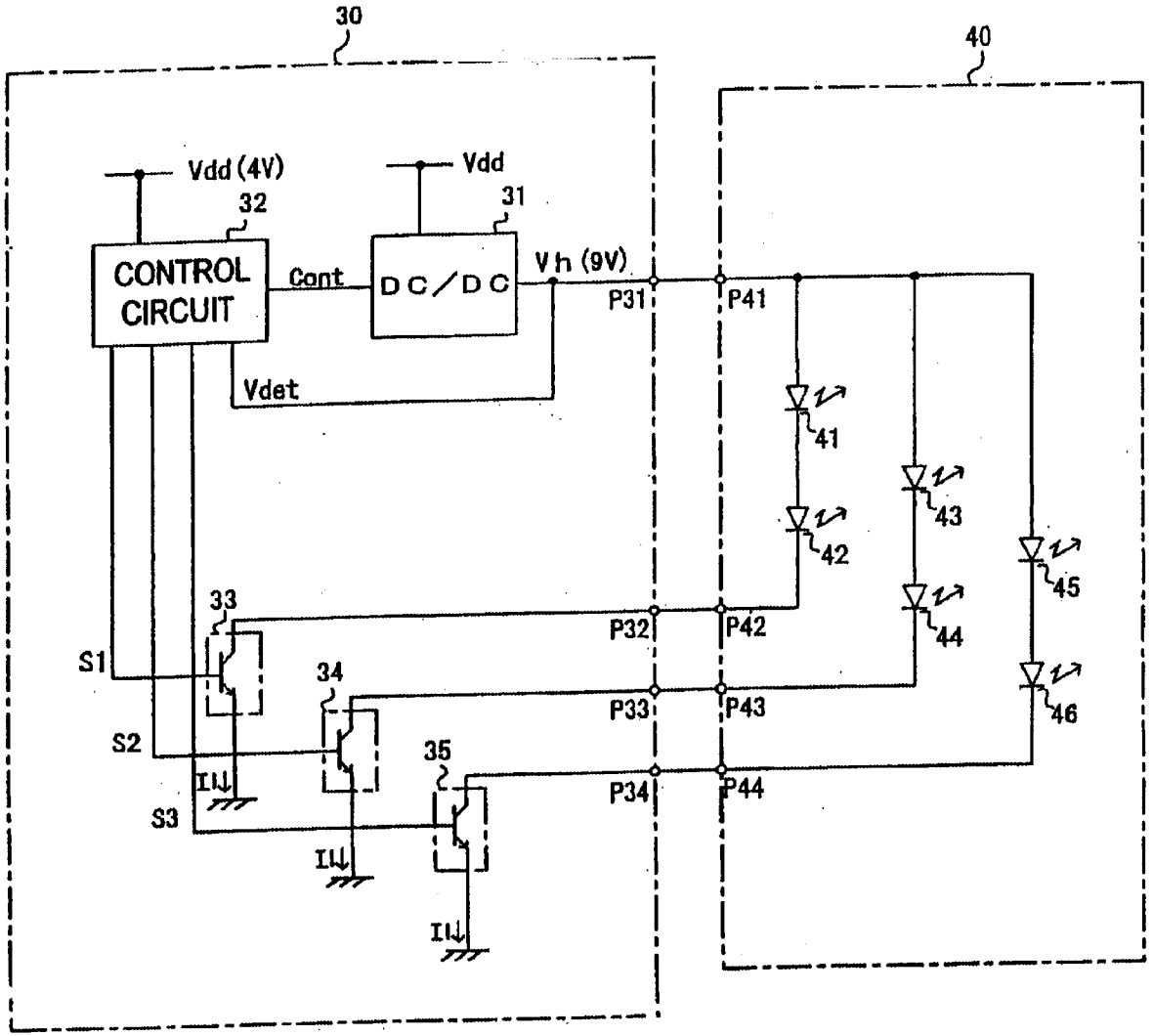
FIG. 4 (PRIOR ART)
FIG. 4 is a circuit diagram of a conventional drive device for driving LEDs used in a cellular phone.
Figure 5:
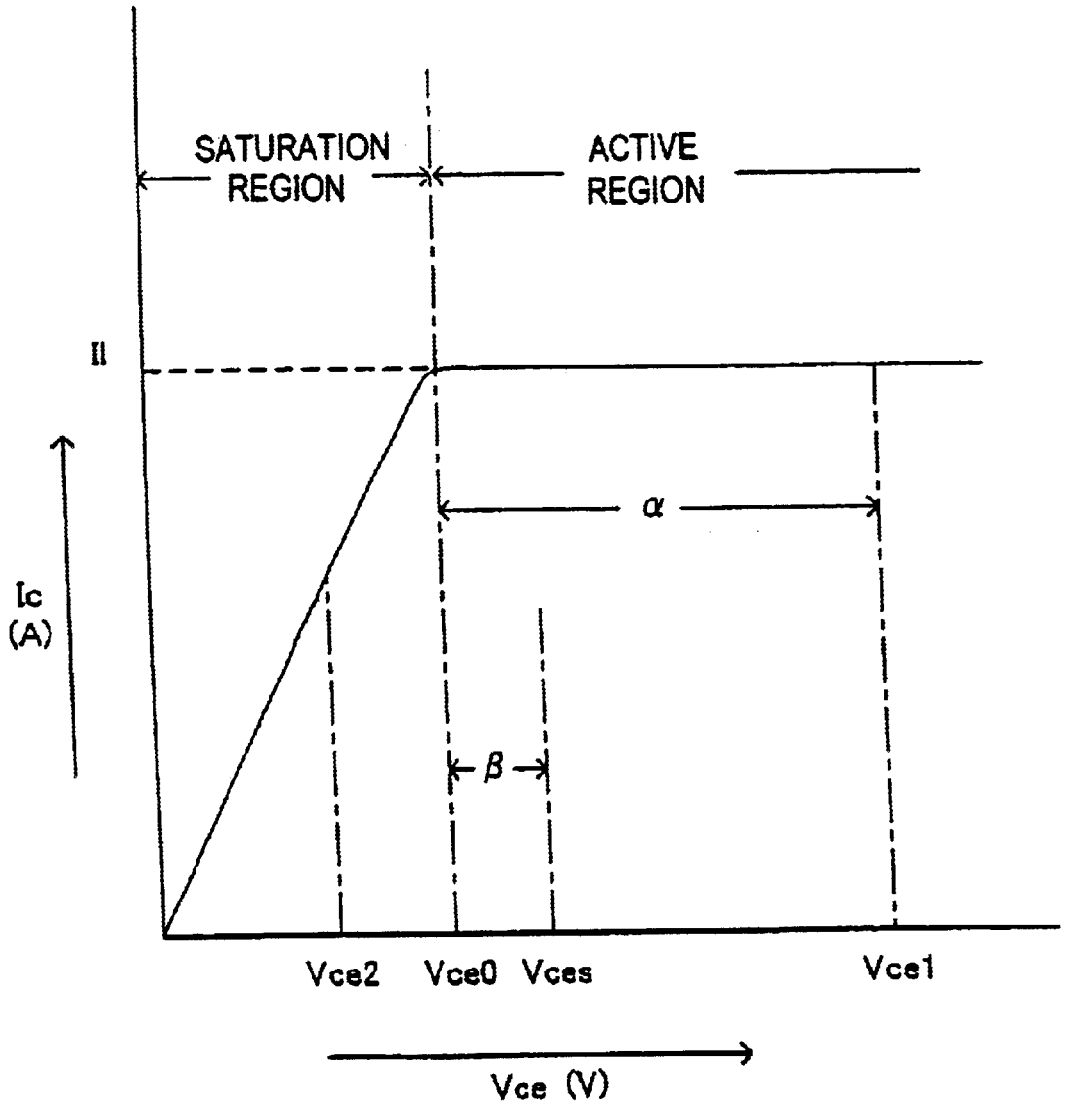
FIG. 5 shows the operating characteristic of a constant-current driver.

FIG. 1 illustrates a general circuit structure of an electronic apparatus equipped with light emitting elements in accordance with one embodiment of the invention. FIG. 2 is a circuit diagram of an exemplary selection circuit for selecting the lowest voltage from a multiplicity of voltages fed thereto. FIG. 3 is a graphical representation of the current-voltage characteristic of the LED serving as a light emitting element.

As shown in FIG. 1, the electronic apparatus includes a drive device 10 and a display device 20.

The display device 20 is formed in an IC chip for use as a display unit of an electronic apparatus such as a cellular phone.

The display device 20 is provided with first through third groups of serially connected light emitting elements (light emitting element series) including LEDs 21 and 22, LEDs 23 and 24, and LEDs 25 and 26, respectively. In the example shown herein, the multiplicity N of light emitting element series is 3. Using these LEDs, a multiplicity M of independently operable sections (e.g. 2 sections) of the electronic apparatus are activated for emission of light.

A nominal current $I_f$ must be passed through each series of the LEDs 21–26 to activate the LEDs for emission of a predetermined amount of light. The voltage $V_f$ impressed on respective LEDs 21–26 varies from one LED to another because of variation in the manufacturing process. For example, $V_f$ of a white LED and of a blue LED is likely to vary in a range of 3.4V to 4.0V.

Thus, taking account of maximum variation in $V_f$ of an LED to be 4V, which amounts to 8V for two serially connected LEDs, it is a common practice to prepare a step-up voltage Vh of about 9V for $2V_f$ plus an extra voltage for controlling the LEDs.

The step-up voltage Vh (e.g. 9V) is obtained by stepping up a power supply voltage Vdd (=4V) using a step-up switching power supply circuit 27. The power supply circuit 27 has a coil L27 connected in series with an N-type MOS transistor Q27 serving as a control switch. This series circuitry is connected between the power supply voltage Vdd and the ground. The step-up voltage Vh, provided at the node of the coil L27 and the MOS transistor Q27, is supplied to an output capacitor C27 via a Schottky diode D27 that incurs only a negligible voltage drop.

In order to generate the step-up voltage Vh, the power supply circuit 27 receives at a pin P21 thereof a switching control signal Cont from the drive device 10 to perform ON-OFF control of the transistor Q27. The step-up voltage Vh thus generated is supplied to respective first ends (LED 21, LED 23, and LED 25 in the example shown herein) of the light emitting element series.

The drive device 10 for driving the display device 20 is also formed in an IC chip.

The drive device 10 has a control circuit 11 for generating different kinds of control signals, drivers 12–14 for driving the LEDs 21–26, constant-current sources 15–17 connected in parallel with the respective drivers 12–14 and functioning as bypass means, and a selection circuit 18 for selecting the lowest voltage from a multiplicity of voltages inputted thereto and outputting it as a detection voltage Vdet.

The control circuit 11 receives the detection voltage Vdet and compares the detection voltage Vdet with an internal reference voltage (not shown) to generate a switching control signal Cont at a pin P11 of the control circuit, which signal is supplied to the gate of the transistor Q27 of the power supply circuit 27 so as to equilibrate the detection voltage Vdet with the reference voltage. Accordingly, a step-up voltage Vh is outputted from the power supply circuit 27 in accord with the control signal Cont.

The control circuit 11 also outputs instruction signals S1–S3 to the respective drivers 12–14. The drivers 12–14 are connected between the ground and respective pins P12–P14 to which the second ends (which are LED 22, LED 24, and LED 26 in the example shown herein) of the light emitting element series are connected. The drivers 12–14 are turned ON or OFF by the instruction signals S1–S3, respectively, depending on the levels of the signals S1–S3 being HIGH or LOW. Hereinafter the reception of an instruction signal means the reception of a HIGH signal.

The drivers 12–14 are constant-current drivers providing constant currents to the LEDs when turned ON, causing each of the light emitting elements to emit an amount of light that depends on the magnitude of the current passing through it. These constant-current drivers 12–14 may be, for example, an ordinary transistorized constant-current circuits adapted to be switched ON or OFF by the respective instruction signals S1–S3.

Constant-current sources 15–17 may be constant-current circuits each connected in parallel with associated one of the drivers 12–14. Each of these constant-current sources 15–17 is adapted to pass through it a minute constant current Ib when associated one of the drivers 12–14 is turned OFF. In this sense, the constant-current sources 15–17 can be considered as bypass means. The constant current Ib is a very small current as compared with the constant current Il that flows through the associated constant-current drivers 12–14 during its ON-period. As a consequence, the additional energy loss by any of the associated constant-current sources 15–17 is negligibly small. Nevertheless, such extremely small constant currents Ib flowing through the light emitting elements 21–26 can maintain the elements in stabilized non-luminescent conditions. When the bypass means suffices to simply allow a minute current to flow through a corresponding series of light emitting elements, each of the constant-current sources 15–17 can be replaced by another element such as a resistor.

The selection circuit 18 is supplied with voltages V12, V13, and V14 that are impressed on the constant-current drivers 12, 13, and 14, respectively. The selection circuit 18 automatically selects the lowest voltage of the voltages V12, V13, and V14, and feeds it back to the control circuit 11 as the detection voltage Vdet.

FIG. 2 shows an exemplary circuit of the selection circuit 18. As shown in FIG. 2, the selection circuit 18 includes parallelly connected P-type MOS transistors (hereinafter referred to as P-type transistors) Q182, Q183, and Q184, respectively receiving the voltages V12, V13, and V14 at their gates. An N-type MOS transistor (hereinafter referred to as N-type transistor) Q186 is connected in series with the P-type transistor Q184. This series circuitry is connected between the ground and the power supply voltage Vdd via a constant-current source 181. Also connected between the ground and the power supply voltage Vdd via the constant-current source 181 are a serially connected P-type transistor Q181 and an N-type transistor Q185. The bases of the N-type transistors Q185 and Q186 are connected together, and the bases are further connected to the drain of the N-type transistor Q185.

A constant-current source 182 and an N-type transistor Q187 are connected in series between the power supply voltage Vdd and the ground. The node of the constant-current source 182 and the N-type transistor Q187 is connected to the gate of the P-type transistor Q181. The detection voltage Vdet is extracted from the node. The gate of the N-type transistor Q187 is connected to the drain of the N-type transistor Q186.

The selection circuit 18 of FIG. 2 is configured to select the lowest voltage of the voltages V12, V13, and V14, and to output the selected voltage as the detection voltage via a voltage follower utilizing an operational amplifier. Thus, the lowest one of the voltages V12, V13, and V14 can be obtained in a stable manner as the detection voltage Vdet.

Referring to FIG. 1 and FIG. 3, operation of the electronic apparatus of the invention will now be described.

Consider first a case in which the first through third light emitting element series are simultaneously activated for emission of light. In this case, the control circuit 11 first generates a switching-control signal Cont and supplies it to the power supply circuit 27. The control signal Cont performs ON-OFF control of the control switch Q27 of the power supply circuit 27, thereby charging the capacitor C27 to the step-up voltage Vh. Moreover, the step-up voltage Vh is supplied to each of the light emitting element series.

At the same time, instruction signals S1–S3 are supplied from the control circuit 11 to the respective constant-current drivers 12–14. This causes the constant-current drivers 12–14 to be turned ON to start their constant-current operations, thereby flowing constant currents Il to all of the LEDs 21–26 of the light emitting element series.

A typical current-voltage characteristic ($I_f$–$V_f$ curve) is shown in FIG. 3 for a white LED. The abscissa represents logarithmic current $I_f$ and the ordinate represents voltage $V_f$. The LED emits light when activated by the current $I_f$ in the range between 1.5–20 mA. FIG. 2 shows a case where current $I_f$ is 20 mA. In this instance, each LED is operated at current 20 mA and voltage 3.4V, as indicated by point A of FIG. 3.

Each of the constant-current drivers 12–14, therefore, is set to provide a constant current Il of 20 mA for the LED to emit a predetermined amount of light. However, as stated previously, the current-voltage characteristics of the respective LEDs are not exactly the same, so that the voltage $V_f$ varies in the range of about 3.4V–4.0V if the current is fixed at 20 mA.

Thus, if the voltage Vh generated by the power supply circuit 27 were constantly 9V as in conventional circuits, the voltage impressed on the constant-current drivers 12–14 would be $Vh-2\times V_f$, which would turn out to be 2.2V, since the $V_f$ of the LEDs 21 and 22 is 3.4V. In the event that the LEDs happen to have the maximum $V_f$ of 4.0V, the constant-current drivers 12–14 are impressed with 1.0V. The constant-current drivers 12–14 can operate normally and provide a constant current so far as the voltages supplied to the respective drivers 12–14 exceed their saturation voltages (about 0.3V). Therefore, even if the LEDs exhibit such variations in $V_f$, the variations will not affect the operations of the constant-current drivers 12–14.

However, in each of the constant-current drivers 12–14 under constant-current operation, a voltage exceeding the saturation voltage (about 0.3V) of the transistor will result in an internal energy loss (defined by voltage×current). For example, when any of the constant-current drivers 12–14 is impressed with 2.2V, a greater portion of this voltage exceeding 0.3V, or 1.9V, results in an energy loss.

When a system has multiple series of light emitting elements, in view of the possible maximum variations in transistor voltage in the series, constant-current operations of the series are prioritized over voltage control of the respective light emitting elements. Therefore, a measure is not taken for the variation in any particular series of light emitting elements. Hence, in view of the variations in the light emitting characteristic, the voltages to be impressed on the constant-current drivers 12–14 are conventionally set to include some margin.

In the invention, however, voltages V12–V14 impressed on the constant-current drivers 12–14 are inputted to the selection circuit 18, which selects the lowest one of the voltages V12–V14 as the detection voltage Vdet and feed it back to the control circuit 11.

The control circuit 11 compares the detection voltage Vdet with the internal reference voltage and, based on the comparison, generates a control signal Cont. The step-up voltage Vh of the power supply circuit 27 is controlled in response to the control signal Cont such that the detection voltage Vdet equals the reference voltage.

The reference voltage is set to a level such that each of the constant-current drivers 12–14 provides a sufficient constant current Il, yet they are impressed with as small excessive voltages as possible. For this reason, the reference voltage is set to the voltage Vces which is slightly larger than the voltage Vce0 by a margin β, where Vce0 is the boundary voltage between the saturation region and the active region of the transistors of the constant-current drivers 12–14.

Thus, the output voltage Vh of the power supply circuit is automatically controlled so that the lowest one of the voltages V12–V14 impressed on the respective constant-current drivers 12–14 becomes equal to the reference voltage Vces. Accordingly, even if the LEDs 21–26 have manufacturing variations in the light emission characteristic, the LEDs can be fully activated for emission of light while minimizing the energy loss by the constant-current drivers 12–14.

Next, we consider a case where one of the first through the third light emitting element series, for example the third series including the LED 25 and LED 26, is not activated for emission of light.

In this case, an instruction signal S3 is not supplied from the control circuit 11 to the constant-current driver 14, so that the driver 14 is turned OFF. Consequently, the LED 25 and LED 26 of the third light emitting element series do not emit light.

It should be noted that if the constant-current driver 14 were merely turned off, no current would flow through the LEDs 25 and 26 that the step-up voltage Vh of the power supply circuit 27 would be impressed on the pin P14 of the drive device 10.

In this invention, however, the constant-current drivers 12–14 are respectively connected in parallel with the constant-current sources 15–17 serving as bypass means. Accordingly, a minute constant current Ib flows from the constant-current source 17 to LED 25 and LED 26 if the constant-current driver 14 is turned OFF. This causes the voltage of the pin P14 of the drive device 10 to be lower than the step-up voltage Vh.

That is, as seen from the $I_f$–$V_f$ curve shown in FIG. 3, voltage $V_f$ will not lower greatly if current $I_f$ is reduced greatly below the range of activation current (1.5 mA–20 mA) required for emission of light. In this example, the minute constant current Ib is set to 10 μA. In this case, current $I_f$ of 10 μA flows through each LED, creating voltage $V_f$ of 2.45V across the LED, as indicated by point B on the curve. With the current $I_f$ being 10 μA, the LEDs will not be sufficiently activated for emission of visible light.

Under this condition, the voltage V impressed on the constant-current source 17 will be Vh minus the sum of two voltage Vf of the LEDs 25–26, or $V=Vh-2\times V_f$. Assuming that $V_f$ is 2.45V, the voltage V turns out to be 4.1V. The voltage V will become still lower when the voltage Vf is closer to the upper bound of its variation.

The voltage impressed on the constant-current source 17, i.e. 4.1V, is sufficient for the constant-current source 17 to function as a constant-current source. Yet this voltage is lower than the withstand voltage (between about 6.0V and 6.5V) of the drive device 10. The level of the constant current Ib can be further reduced while keeping the voltage impressed on the pin 14 below the withstand voltage of the drive device 10. In practice, the constant current Ib is preferably set to about 1.0 μA.

The constant current Ib is wasteful in that it does not contribute to the luminescence of LEDs. But since the current Ib is far smaller than the constant current I1 for the activation of the LEDs (Ib being smaller than I1 by several orders of magnitude), the energy loss due to the current Ib is negligible.

Although the invention has been described above with a particular reference to the case in which each of three light emitting element series has two LEDs, it should be understood that the invention will not be limited to this embodiment. The invention can be modified arbitrarily within the spirit and the scope of the invention. For example, the number of the series can be more than three and each of the series can includes one LED or more than two LEDs.

INDUSTRIAL APPLICABILITY

As described above, a drive device of the invention is suitable for use as a drive of light emitting elements such as LEDs serving as backlight sources of an LCD. Such LCD can be suitably installed in an electronic apparatus such as a cellular phone.

What is claimed is:

1. A drive device for driving a multiplicity of light emitting element series each including at least one light emitting element, said drive device comprising:

a multiplicity of drivers having first ends connected to a multiplicity of terminals to which said light emitting element series are respectively connected, each of said drivers turned ON or OFF in accordance with an instruction signal supplied thereto such that, when turned ON, said driver provides a current to associated one of said light emitting element series for emission of light;

a selection circuit receiving the voltages that are respectively impressed on said drivers, said selection circuit adapted to select the lowest voltage from said voltages and output said lowest voltage as a detection voltage; and a control circuit for controlling the drive voltage applied to said light emitting element series by a power supply circuit by comparing said detection voltage with a reference voltage to generate a control signal to said power supply circuit so as to equilibrate said detection voltage with said reference voltage.

2. The drive device according to claim 1, wherein said light emitting elements are light emitting diodes.

3. The drive device according to claim 1 or 2, further comprising a multiplicity of bypass means, each connected in parallel with associated one of said multiplicity of drivers, for providing said light emitting element series with currents that are not sufficient to activate said light emitting element series for emission of light when associated drivers are turned OFF.

4. The drive device according to claim 3, wherein said drivers are constant-current drivers for providing a constant current when turned ON; and said bypass means are constant-current sources.

5. An electronic apparatus comprising:

a display device having:

a power supply circuit for converting a given power supply voltage to another output voltage in response to a control signal supplied thereto; and a multiplicity of light emitting element series each including at least one light emitting element and having a first end connected to said output voltage and a second end connected to associated one of different terminals, and a drive device having:

a multiplicity of drivers having first ends connected to said different terminals, each of said drivers turned ON or OFF in accordance with an instruction signal supplied thereto such that, when turned ON, said driver provides a current to activate associated one of said light emitting element series for emission of light;

a selection circuit receiving voltages that are respectively impressed on said drivers, said selection circuit adapted to select the lowest voltage from said voltages and output said lowest voltage as a detection voltage; and a control circuit for outputting a control signal to said power supply circuit so as to equilibrate said detection voltage with said reference voltage by comparing said detection voltage with a reference voltage.

6. The electronic apparatus according to claim 5, wherein said power supply circuit is a step-up type power supply circuit for stepping up said power supply voltage, and said another output voltage is higher than said power supply voltage.

7. The electronic apparatus according to claim 6, wherein each of said light emitting element series is composed of light emitting diodes.

8. The electronic apparatus according to claim 6 or 7, further comprising a multiplicity of bypass means, each connected in parallel with associated one of said multiplicity of drivers, for providing said light emitting element series with currents that are not sufficient to activate said light emitting element series for emission of light when associated drivers are turned OFF.

9. The electronic apparatus according to claim 8, wherein said drivers are constant-current drivers for providing a constant current when turned ON; and said bypass means are constant-current sources.

* * * * *